US008704160B1

(12) United States Patent
Zhdaneev

(10) Patent No.: US 8,704,160 B1
(45) Date of Patent: Apr. 22, 2014

(54) DOWNHOLE ANALYSIS OF SOLIDS USING TERAHERTZ SPECTROSCOPY

(71) Applicant: Schlumberger Technology Corporation, Sugar Land, TX (US)

(72) Inventor: Oleg Zhdaneev, Bergen (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/739,824

(22) Filed: Jan. 11, 2013

(51) Int. Cl.
*G01J 3/28* (2006.01)
*G01N 21/35* (2014.01)

(52) U.S. Cl.
CPC ..... *G01N 21/3581* (2013.01)
USPC ..... 250/269.1

(58) Field of Classification Search
CPC ..... G01N 21/3581; G01N 21/532
USPC ..... 250/253, 269.1
See application file for complete search history.

(56) References Cited

U.S. PATENT DOCUMENTS

| | | | | |
|---|---|---|---|---|
| 4,714,119 | A | 12/1987 | Herbert et al. | |
| 5,166,747 | A | 11/1992 | Schroeder et al. | |
| 5,667,025 | A | 9/1997 | Haessly et al. | |
| 7,781,737 | B2 | 8/2010 | Zhdaneev | |
| 7,789,170 | B2 | 9/2010 | Church | |
| 2009/0296086 | A1 * | 12/2009 | Appel et al. | 356/326 |

* cited by examiner

*Primary Examiner* — Mark R Gaworecki
(74) *Attorney, Agent, or Firm* — Jakub M. Michna; Bridget Laffey

(57) ABSTRACT

Methods and apparatus are provided for determining the composition of solid materials located downhole in a formation. Examples of solid materials that may be investigated downhole include scale and formation cores.

23 Claims, 3 Drawing Sheets

DOWNHOLE ANALYSIS OF SOLIDS USING TERAHERTZ SPECTROSCOPY

BACKGROUND

1. Field of the Invention

This case relates to the downhole evaluation of solid materials using terahertz spectroscopy. More particularly, this case relates to downhole apparatus and methods for evaluating or characterizing compositional analysis of solid material such as formation cores or such as scale deposits in a wellbore, although it is not limited thereto.

2. State of the Art

Precise and real-time information is desirable for optimal evaluation and development of oil-gas-water reservoirs. The evaluation of the formation properties is a major factor in dictating reservoir development strategies including well design and production methods, and can ultimately impact recovery factors. Real-time data (obtained downhole) about the formation and the formation fluids are a valuable source of information during reservoir evaluation.

One aspect of formation characterization relates to the geological makeup of the formation. While formation samples (e.g., cores) can be obtained downhole and brought uphole for evaluation at a surface laboratory to obtain data, in some cases the delay can result in well-development mistakes that could have been avoided or predicted had real-time data been available.

Another aspect of the evaluation and development of oil-gas-water reservoirs relates to the flow of fluid in the formation, borehole or completed wellbore. By way of example only, it is not uncommon in a reservoir that barium may have slowly leached over geological time so that it is present in aqueous solution. This situation is stable until sulfate rich seawater is injected into the formation for production purposes. A chemical reaction then occurs and produces an unstable super-saturated barium-sulfate solution that will start to crystallize (i.e., form scale) with only small changes in temperature or pressure. Conditions for scale deposition can occur in one or more of the formation itself, the perforation tunnel of the casing, the wellbore or the tubing (pipe). A buildup of scale can significantly impact production. Because barium-sulfate is not radioactive, a gamma ray logging tool cannot detect the barium-sulfate scale. Likewise, while a calipers tool can detect the build-up of scale in the wellbore or tubing, it cannot determine the composition of the scale deposit.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to one aspect, a downhole terahertz analysis system that analyzes solid materials is provided. The downhole terahertz analysis system includes a borehole tool suspended in a borehole including a terahertz radiation source, a terahertz radiation detector, and a signal analyzer coupled to the terahertz radiation detector. In one embodiment particularly adapted for analysis of scale deposits, the terahertz radiation source and terahertz radiation detector are located on the periphery of the borehole tool or on an arm or other element that is adapted to extend out of the elongated body of the borehole tool. In another embodiment particularly adapted for analysis of core samples, the borehole tool further includes a corer and an analysis chamber and the terahertz radiation source and terahertz radiation detector are located adjacent the analysis chamber. The corer is adapted to extend from the body of the borehole tool, cut into the formation to obtain a core sample, and deliver the core sample to the analysis chamber.

DETAILED DESCRIPTION

Figure 1:
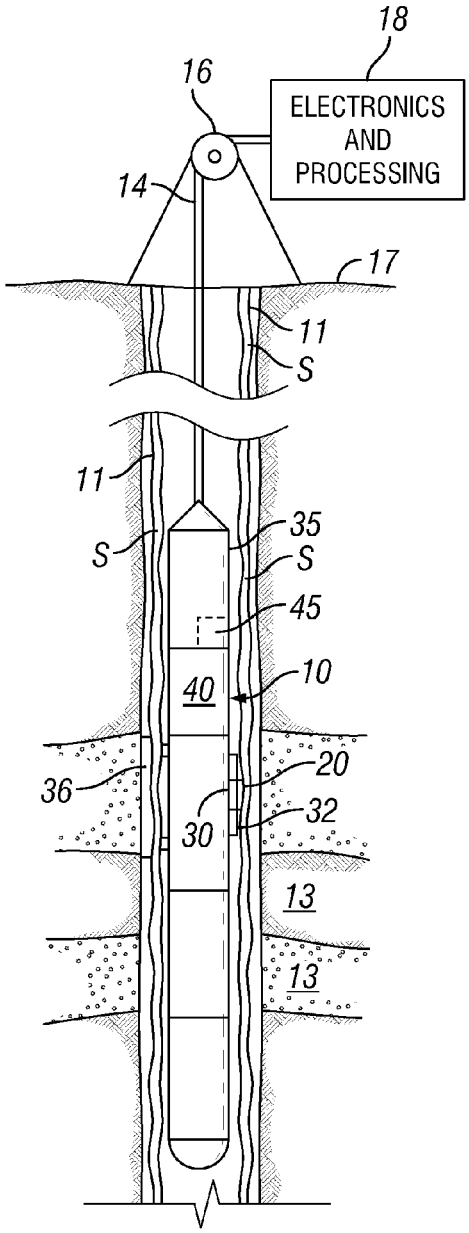
FIG. 1 is a schematic diagram of a borehole tool incorporating a terahertz radiation source and detector for the detection of solid material external the tool.

FIG. 1 is a schematic diagram showing a borehole tool 10 located in a pipe or tubing 11 traversing a formation 13. Inside the pipe is a buildup of scale S. Scale S is typically a crystalline or powdery substance. The borehole tool 10 is shown suspended by a cable 14 that is spooled in the usual fashion on a suitable winch 16 on the formation surface 17. The cable is coupled to an electrical control system 18 on the formation surface.

Borehole tool 10 includes a terahertz (THz) spectrum radiation source 20 and a THz spectrum detector 30. For purposes herein, the term "terahertz spectrum" is to be understood as the electromagnetic spectrum from 0.01 THz to 100 THz (i.e., from approximately 0.3 to 3000 $cm^{-1}$. Also, for purposes herein, the terms "borehole" and "borehole tool" are to be understood broadly to include boreholes, wells (cased and uncased), etc., and tools that are run in those boreholes and wells. The borehole tool 10 may also include a downhole signal analyzer 40 (as shown), or the signal analyzer may be located uphole as part of or separate from the electrical control system 18. The signal analyzer 40 may include or have access to a database of spectral data 45 that includes spectral responses of different solids to a given THz irradiation source such as source 20. In one embodiment the database includes spectral responses of different types of scale (e.g., the sulfates and carbonates of barium, calcium, strontium and radium) to a given THz irradiation source such as source 20. It will be appreciated that the fraction of THz radiation absorbed per unit path length of a solid sample depends on the chemical composition of the sample and the wavelength of the THz radiation. Selective absorption in the THz wavelength region can be used for composition analysis by the signal analyzer 40.

In one embodiment, the THz source 20 and THz detector 30 are located on an arm 32 that can extend away from the elongated body 35 of the borehole tool 10. In one embodiment, the THz source 20 and THz detector 30 are located on the periphery of the elongated body 35 of the borehole tool 10. In one embodiment, the borehole tool includes a selectively extendible tool anchoring arm 36. Where an extendible tool anchoring arm 36 and/or an extendible arm 32 housing the THz source 20 and detector 30 is provided, the THz source 20 and THz detector 30 can be brought into contact with or adjacent to the scale S in the pipe.

The THz radiation source 20 may comprise any of many types of sources. By way of example only, in one embodiment, the THz radiation source is a continuous wave source of narrow-band THz radiation. In another embodiment, the THz radiation source comprises a backward wave oscillator. In another embodiment, an optically pumped THz laser is utilized. Reference may be had to co-owned U.S. Pat. No. 7,781,737 which is hereby incorporated by reference herein in its entirety.

The THz radiation detector 30 may likewise comprise any of many types of detectors including by way of example only bolometers, pyroelectric detectors, photoacoustic cells, Auston switches without the bias, heterodyne sensors, and coherenet detectors. Again, reference may be had to previously incorporated U.S. Pat. No. 7,781,737.

The output of the detector 30 is provided to the signal analyzer 40 in which further processing can be performed. For example, the signal analyzer 40 can compute absorption coefficients for different wavelengths, and these absorption coefficients can be compared to those from the database 45 so that the type(s) and amount/thickness of scale present can be identified. It should be appreciated that the type of scale is determined by what frequencies have been absorbed, whereas the thickness of scale is determined by the amount of absorption at the absorptive frequencies. Where multiple types of scale are present, additional processing (e.g., deconvolution) is involved. For example, in one embodiment, the multiple components (component 1, component 2, . . . component i) of the scale can be determined according to $$\begin{pmatrix} N_1 \\ \vdots \\ N_i \end{pmatrix} = \frac{1}{\text{sample length}} \times \begin{pmatrix} \sigma_1(\omega_1) & \dots & \sigma_i(\omega_1) \\ \sigma_1(\omega_i) & \dots & \sigma_i(\omega_i) \end{pmatrix}^{-1} \times \begin{pmatrix} \ln\left(\frac{I_{01}}{I_1}\right) \\ \vdots \\ n\left(\frac{I_{0i}}{I_i}\right) \end{pmatrix},$$

where N is the components' concentration, $\sigma_1$ $(\omega_1)$ is the absorption at the wavelength $\omega_1$ by the first component, $I_0$ is the radiation intensity before the radiation enters the sample, and I is the radiation intensity after the radiation exits the sample. Thus, by knowing the absorption wavelengths of different components, and by knowing or taking measurements of the sample length and the radiation intensity of the source, and by measuring the radiation intensity at the detector, the concentration of the various components can be determined. It will be appreciated that information about absorption coefficients $\sigma_i$ $(\omega_i)$ can be acquired in the laboratory and stored in a database before actual field work.

In one embodiment, calibration measurements are performed on the source 20 and detector 30 before and after testing of a sample is accomplished in order to validate the operability of the system and record parameters desirable for analysis.

The signal analyzer 40 may comprise any of many types of analyzers including by way of example only a digital signal processor (DSP) or a microprocessor.

In one embodiment, the signal analyzer 40 is located uphole, and information from the THz detector 30 is transmitted uphole. In one embodiment, cable 14 permits data transmission from the THz detector 30 to the signal analyzer 40.

In one embodiment, the results of the signal analysis are displayed. In one embodiment, the display is on an electronic screen such as a computer monitor. In another embodiment, the display is on paper.

Figure 2:
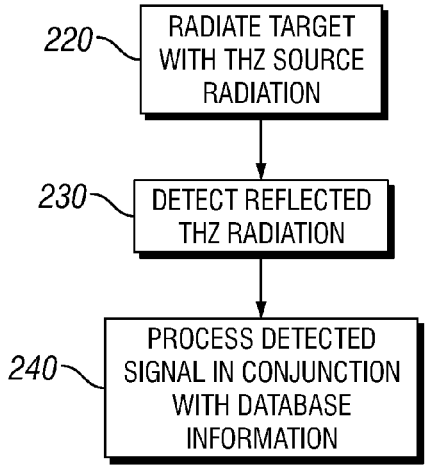
FIG. 2 is a functional block diagram of a method of analyzing the solids investigated by the borehole tool of FIG. 1.

An exemplary method of analyzing the composition of the scale S is shown in FIG. 2. At 220, at least a portion of a spectrum of terahertz radiation is directed from the THz source 20 toward the scale S. At 230 the THz detector 30 detects THz radiation that is reflected back (typically primarily by the pipe, tubing or casing 11). At 240, the detected signal is processed by the signal analyzer 240 in conjunction with a spectral database 45. In particular, the detected signal will have the features that reflect the scale composition due to specific phonon interaction that depends on the chemical composition of the scale. As a result, the signal analyzer provides an analysis of the makeup of the scale and/or the thickness of the scale.

Figure 3:
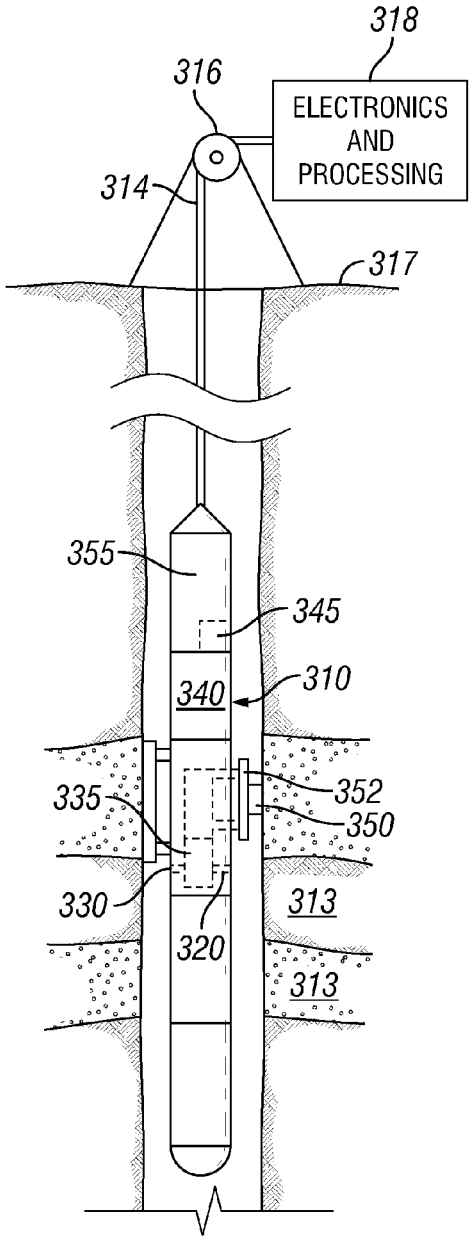
FIG. 3 is schematic diagram of a borehole tool incorporating a terahertz radiation source and detector for detection of solid material extracted from a formation and brought internal to the tool.

Turning now to FIG. 3, a schematic diagram is seen of another embodiment of a borehole tool 310. Borehole tool 310 is shown located in a borehole 311 traversing a formation 313. The borehole tool 310 is shown suspended by a cable 314 that is spooled in the usual fashion on a suitable winch 316 on the formation surface 317. The cable is coupled to an electrical control system 318 on the formation surface.

Figure 4:
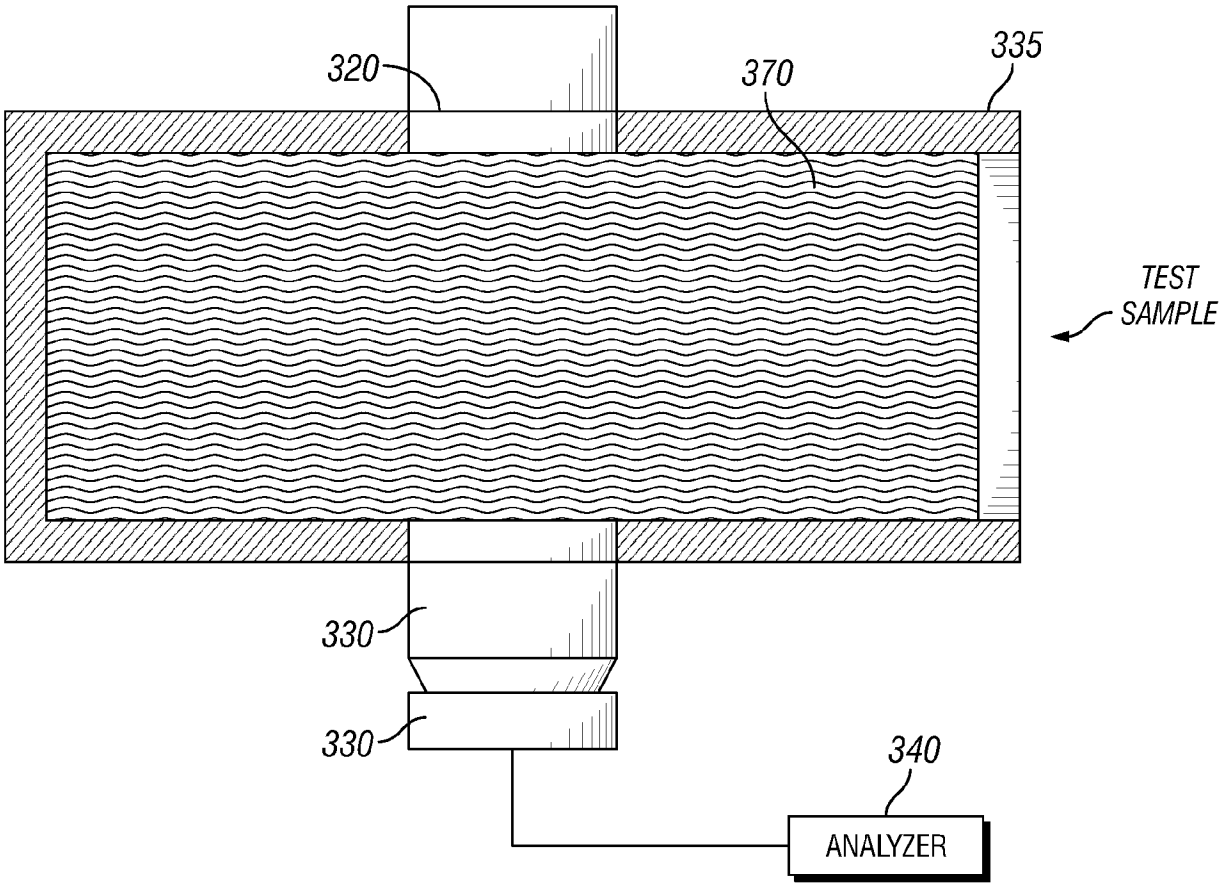
FIG. 4 is a schematic diagram of a chamber arrangement for the borehole tool of FIG. 3.

Borehole tool 310 includes a terahertz (THz) spectrum radiation source 320 and a THz spectrum detector 330 which are located adjacent an internal sample chamber 335 (seen also in FIG. 4). The borehole tool 310 may also include a signal analyzer 340 (as shown), or the signal analyzer may be located uphole as part of or separate from the electrical control system 318. The signal analyzer 340 is coupled to the THz detector 330 and may include or have access to a database of spectral data 345. In one embodiment the database 345 includes spectral responses of different lithologies (sandstones, limestones, carbonates) to a given THz irradiation source such as source 320. In another embodiment, the database 345 includes spectral responses of a plurality of component elements of different rock lithologies to a given THz irradiation source.

Borehole tool 310 is also provided with a sidewall coring element or bit 350 located on an arm 352 that can extend or rotate away from the elongated body 355 of the borehole tool 310 and can drill into the formation and retrieve a formation sample (core) 370 (seen in FIG. 4). Examples of sidewall coring elements may be seen in co-owned U.S. Pat. Nos. 4,714,119, 5,667,025, and 7,789,170 all of which are hereby incorporated by reference herein in their entireties. When retracted into the body 355 of tool 310, the coring element 350 is placed in communication with sample chamber 335 so that the sample can be transferred thereto. In one embodiment, the sample is transferred via suction. In another embodiment, the sample is subject to centrifuge sampling in order to extract fluid from the core sample before analysis of the core sample.

In one embodiment, and as seen in FIG. 4, sample chamber 335 is adapted to receive formation sample 370, and the THz source 320 and THz detector 330 are arranged such that THz spectrum radiation from source 320 can be directed into and through the sample 370, and the THz radiation passing through the sample is detected by the THz spectrum detector 330. It will be appreciated that the sample 370 will often contain formation fluids such as oil, gas or water. As a result, the signal received by the THz detector 330 will be indicative of both the fluid and solid components of the sample; i.e., both fluid and solid components will absorb at particular frequencies, and the detected signal intensities (i.e., absorbance) at various frequencies will indicate the presence and amounts of the components. Where the core sample constitutes multiple components, deconvolution of the detected signal can be performed by the signal analyzer 340.

In one embodiment the signal that corresponds to the solid part of the core may be subtracted from the signal so that the resulting signal reflects key features of fluids in the core pores.

In another embodiment, if the formation fluid content is known or can be assumed, the signal corresponding to the fluid in the core may be subtracted from the signal so that the resulting signal reflects only the constituents of the solid part of the core.

In one embodiment, the sample chamber is adapted to be emptied of the solid sample so that another solid sample may be introduced into the sample chamber and examined.

Figure 5:
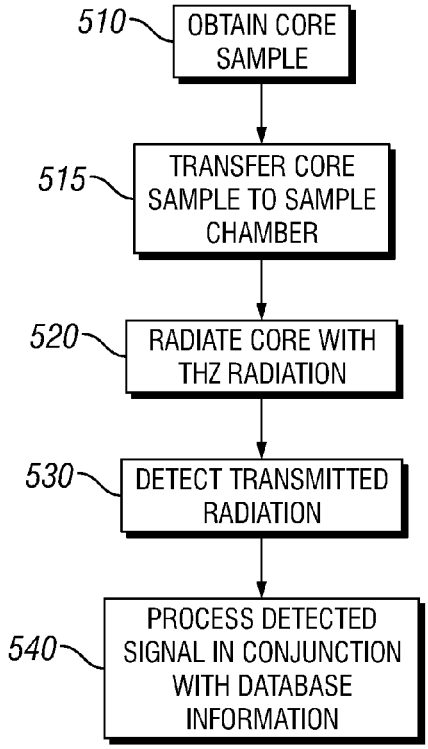
FIG. 5 is a functional block diagram of a method of analyzing the solids investigated by the borehole tool of FIG. 3.

An exemplary method utilizing the borehole tool 310 is seen in FIG. 5. At 510, the borehole tool 310 is activated to obtain a core sample 370 of the formation. At 515, the core sample is transferred to the sample chamber 335. At 520 at least a portion of a spectrum of terahertz radiation is directed from the THz source 320 through the sample 370. At 530 the THz detector 30 detects THz radiation that is transmitted. At 540, the detected signal is processed by the signal analyzer 540 in conjunction with spectral database 345. In particular, the detected signal will have the features that reflect the composition due to specific phonon interaction that depends on the chemical composition of the sample (both fluid and solid). As a result, the signal analyzer 340 provides an analysis of the makeup of the fluid and solid.

In one embodiment, prior to analyzing the detected signal, utilizing previously known information, the portion of the signal corresponding to either the solid part of the core sample or the fluid part of the core sample is subtracted from the signal so that the signal that is analyzed corresponds respectively to only the fluid part or the solid part of the core sample.

In one embodiment, the results of the signal analysis are displayed on a display. In one embodiment, the display is an electronic screen such as a computer monitor. In another embodiment, the display is paper.

There have been described and illustrated herein several embodiments of borehole tools, and methods associated therewith. While particular embodiments have been described, it is not intended that the disclosure be limited thereto, and it is intended that the claims be as broad in scope as the art will allow and that the specification be read likewise. Thus, while particular THz sources and detectors were described, it will be appreciated that others could be utilized. Also, while the detection and identification of scale was described with respect to scale located in a pipe, it will be appreciated that the detection and identification of scale could be with respect to scale located in a borehole or otherwise downhole. Further, while the embodiments were described with reference to logging tools, it will be appreciated that the embodiments could be utilized in conjunction with a drilling tool. It will therefore be appreciated by those skilled in the art that yet other modifications could be made. Accordingly, all such modifications are intended to be included within the scope of this disclosure as defined in the following claims. In the claims, means-plus-function clauses, if any, are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An apparatus for investigating downhole in a borehole traversing an earth formation, comprising:

a) a borehole tool including a terahertz radiation source that generates a THz spectrum radiation at a plurality of frequencies expected to be absorbed by solid materials located in the borehole or in the formation and directs said THz spectrum radiation at the solid materials, and a terahertz radiation detector that detects the THz radiation resulting from an interaction of said solid materials with said THz spectrum radiation generated by said terahertz radiation source as said THz radiation passes through the solid materials;

b) a database of spectral responses of a plurality of solid material elements to THz radiation; and c) a signal analyzer coupled to said terahertz radiation detector, said signal analyzer adapted to determine from information received from said terahertz radiation detector and from said database a chemical makeup of the solid materials.

2. An apparatus according to claim 1, wherein:

said borehole tool includes a tool body and an arm extendible from said tool body, wherein said terahertz radiation source and said terahertz radiation detector are located on said tool arm.

3. An apparatus according to claim 2, wherein:

said database includes spectral responses of a plurality of different types of scale.

4. An apparatus according to claim 1, wherein:

said borehole tool includes a tool body having a periphery, wherein said terahertz radiation source and said terahertz radiation detector are located on said periphery of said tool body.

5. An apparatus according to claim 4, wherein:

said borehole tool includes an extendible tool anchoring arm located opposite said terahertz radiation source on said tool body.

6. An apparatus according to claim 5, wherein:

said database includes spectral responses of a plurality of different types of scale.

7. An apparatus according to claim 1, wherein:

said borehole tool includes a tool body and a sidewall coring element capable of extending or rotating away from said tool body, drilling into the formation and retrieve a formation sample.

8. An apparatus according to claim 7, further comprising:

said borehole tool includes sample chamber adapted to receive the formation sample, wherein said terahertz radiation source and said terahertz radiation detector are located adjacent said sample chamber.

9. An apparatus according to claim 8, wherein:

said terahertz radiation source and said terahertz radiation detector are located opposite each other on opposed sides of said sample chamber.

10. An apparatus according to claim 8, wherein:

said database further includes spectral responses of fluids including oil, water and gas.

11. An apparatus according to claim 1, further comprising:

a display coupled to said analyzer, said display adapted to display information indicative of said chemical makeup of the solid materials.

12. A method for investigating downhole in an earth formation traversed by a borehole, comprising:

generating THz spectrum radiation at a plurality of frequencies expected to be absorbed by solid materials located in the borehole or in the formation and directing the THz spectrum radiation at the solid materials downhole;

detecting downhole the THz radiation resulting from an interaction of said solid materials with said THz spectrum radiation;

from the detected THz radiation, determining a chemical composition of the solid materials.

13. A method according to claim 12, further comprising:

displaying an indication of the chemical composition.

14. A method according to claim 12, wherein:

said determining comprises using a database of spectral responses of a plurality of solid material elements to THz radiation.

15. A method according to claim 12, wherein:

said solid materials comprises scale in the borehole.

16. A method according to claim 12, further comprising:

prior to said generating, obtaining a core of the earth formation, said core constituting said solid materials.

17. A method according to claim 16, wherein:

said determining comprises using a database of spectral responses of a plurality of solid material elements to THz radiation.

18. A method according to claim 17, wherein:

said core includes fluids, and said database includes spectral responses of a plurality of fluids to THz radiation.

19. A method for investigating downhole in an earth formation traversed by a borehole, comprising:

generating THz spectrum radiation at a plurality of frequencies expected to be absorbed by solid materials located in the borehole or in the formation and directing the THz spectrum radiation at the solid materials downhole;

prior to said generating, storing absorption wavelength information regarding the solid materials;

detecting downhole indications of the THz radiation resulting from an interaction of said solid materials with said THz spectrum radiation; and determining chemical composition and concentration of the solid materials by processing the indications using said absorption wavelength information.

20. A method according to claim 19, wherein:

said solid materials comprises materials of at least two different compositions, and said processing includes deconvolution in order to determine a concentration for each of the different compositions.

21. A method according to claim 20, wherein:

said processing includes knowing or taking measurements of a length of the solid materials and knowing or taking measurements of the intensity of the THz spectrum radiation.

22. A method according to claim 20, wherein:

said solid materials comprises scale in the borehole.

23. A method according to claim 20, further comprising:

prior to said generating, obtaining a core of the earth formation, said core constituting said solid materials.

* * * * *